US008037889B2

(12) United States Patent
Tsai

(10) Patent No.: US 8,037,889 B2
(45) Date of Patent: Oct. 18, 2011

(54) DISPOSABLE CIGARETTE ASH BAG PACKAGE

(76) Inventor: Kai-Mou Tsai, Taipei (TW)

( * ) Notice: Subject to any disclaimer, the term of this patent is extended or adjusted under 35 U.S.C. 154(b) by 954 days.

(21) Appl. No.: 11/798,653

(22) Filed: May 16, 2007

(65) Prior Publication Data

US 2008/0283068 A1 Nov. 20, 2008

(51) Int. Cl.
*A24D 1/12* (2006.01)
*B65D 73/00* (2006.01)

(52) U.S. Cl. ..... 131/231; 206/496

(58) Field of Classification Search ..... None
See application file for complete search history.

(56) References Cited

U.S. PATENT DOCUMENTS

| | | | | |
|---|---|---|---|---|
| 3,512,338 | A * | 5/1970 | Nestler | 53/390 |
| 4,328,895 | A * | 5/1982 | Jaeger | 206/496 |
| 4,989,994 | A * | 2/1991 | Gelbard | 383/37 |
| 5,788,479 | A * | 8/1998 | Galanos et al. | 431/253 |
| 2002/0121455 | A1 * | 9/2002 | Smith et al. | 206/554 |

* cited by examiner

*Primary Examiner* — Richard Crispino
*Assistant Examiner* — Michael J Felton
(74) *Attorney, Agent, or Firm* — Rosenberg, Klein & Lee

(57) ABSTRACT

A disposable cigarette ash bag package includes a set of disposable cigarette ash bags for receiving cigarette ash individually, and an outer bag or box for receiving the set of disposable cigarette ash bags. The disposable cigarette ash bags are smaller one relative another so that they are can be inserted one into another.

10 Claims, 6 Drawing Sheets

DISPOSABLE CIGARETTE ASH BAG PACKAGE

BACKGROUND OF THE INVENTION

1. Field of the Invention

The present invention relates to smoking implements and more specifically, to a disposable cigarette ash bag package for receiving cigarette ash.

2. Description of the Related Art

Everybody knows that smoking is harmful to the health. Medical research has determined that chronic tobacco smoking is a major contributing factor towards lung cancer, emphysema, cardiovascular disease, and many other health problems. Cigarette smoke contains 60 different carcinogens, pollutants that increase the risk of cancer. The health effects of tobacco smoking are related to direct tobacco smoking, as well as inhalation of environmental or secondhand tobacco smoke. Lung cancer rates are linked to the number of people who smoke.

Many countries regulate or restrict tobacco sales and advertising and require warnings to be marked on the product packaging. Many governments now restrict or ban smoking in public places. However, these measures still cannot stop people from tobacco smoking. We frequently see people smoke while walking, chatting with friends, or waiting at bus stop. It is not possible to require a tobacco smoker to carry a heavy ashtray when going outdoors.

SUMMARY OF THE INVENTION

The present invention has been accomplished under the circumstances in view. According to one aspect of the present invention, the disposable cigarette ash bag package comprises a set of disposable cigarette ash bags for receiving cigarette ash individually. The disposable cigarette ash bags have different sizes so that they can be inserted one into another. Further, each disposable cigarette ash bag has a top opening, and a width gradually reducing from the top side toward the bottom side. This design of gradually reducing width enables the disposable cigarette ash bags to be conveniently inserted one into another. According to another aspect of the present invention, the disposable cigarette ash bag package further comprises an outer bag or box for receiving the set of disposable cigarette ash bags.

DETAILED DESCRIPTION OF THE PREFERRED EMBODIMENT

Figure 1:
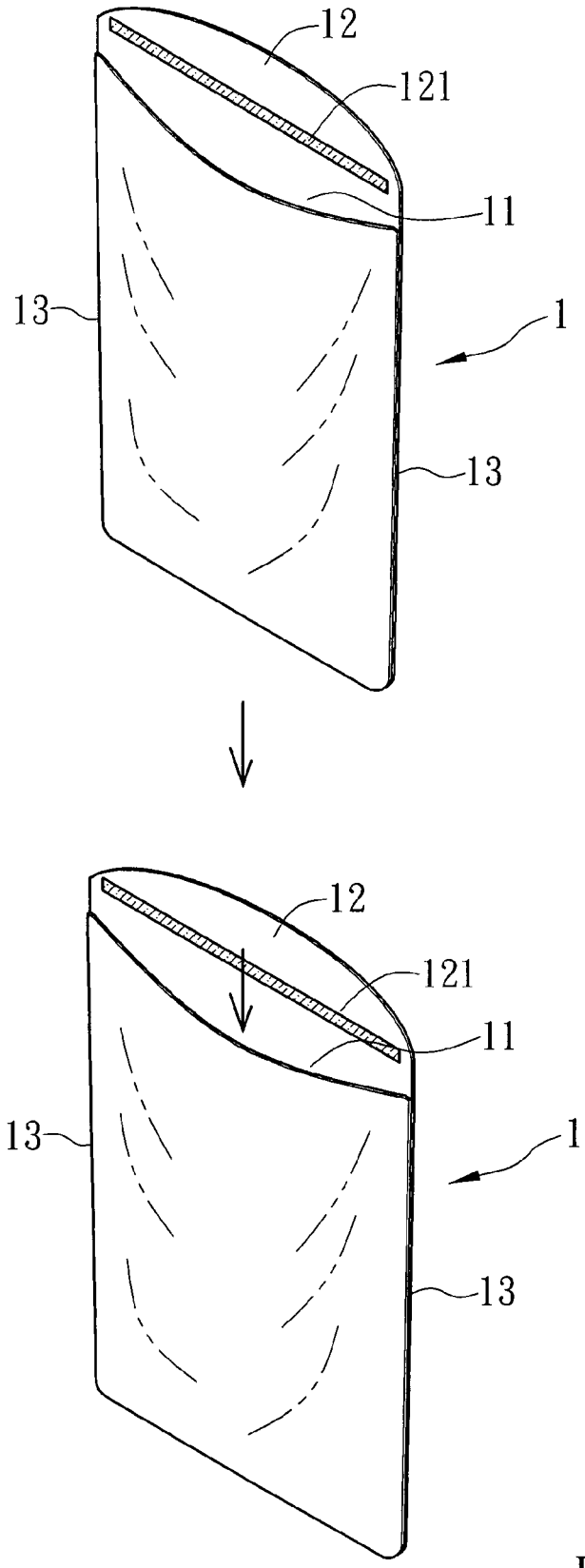
FIG. 1 is an exploded view of two disposable cigarette ash bags according to the present invention.
Figure 2:
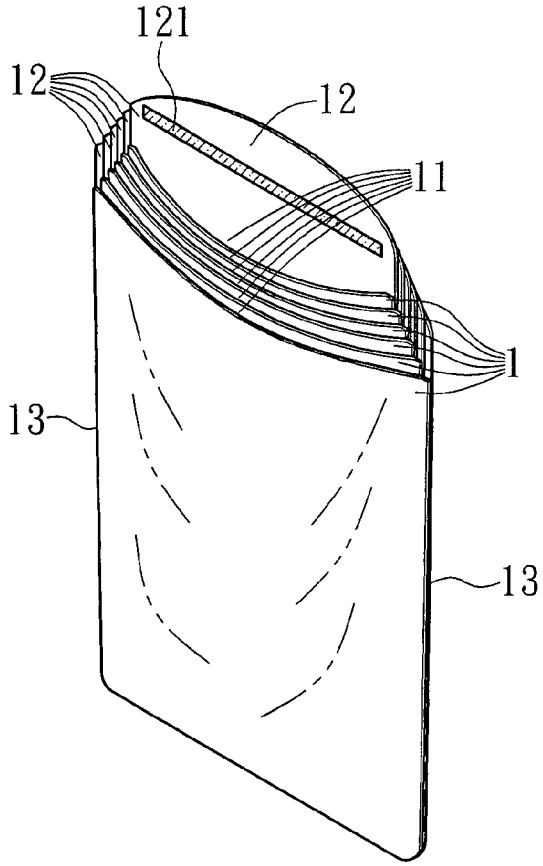
FIG. 2 illustrates a set of disposable cigarette ash bags received together.
Figure 3:
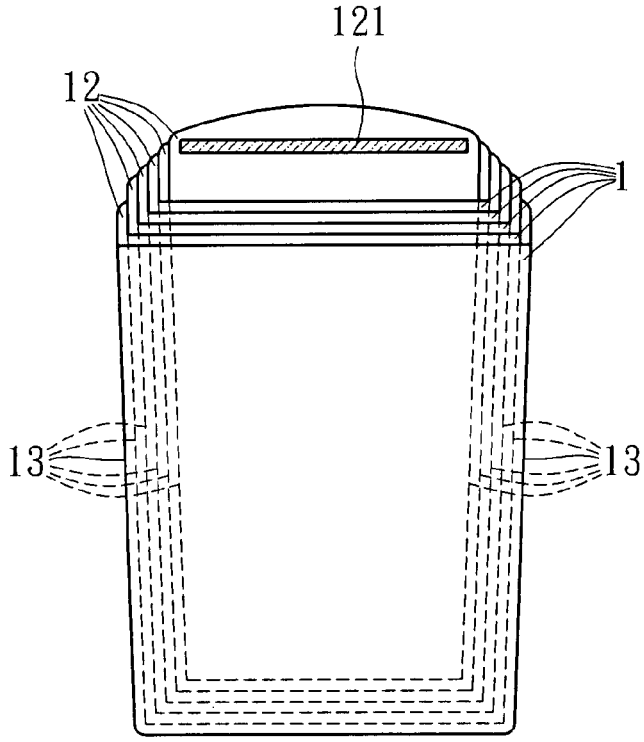
FIG. 3 is a perspective front view of FIG. 2.

Referring to FIGS. 1, 2 and 3, a disposable cigarette ash bag package in accordance with the present invention is shown comprising a set of disposable cigarette ash bags 1. The disposable cigarette ash bags 1 have different sizes so that they can be put one inside another. The disposable cigarette ash bags 1 are made of a paper material coated with a layer of flame retardant coating, each having a top opening 11, a cover flap 12 for closing the top opening 11, a sealing strip 121 provided at the inner surface of the cover flap 12 for adhering the cover flap 12 to the outer surface of the respective disposable cigarette ash bag 1 to hold the cover flap 12 firmly in the close position, Further, the width between the two opposite lateral sides 13 of each disposable cigarette ash bag 1 reduces gradually in direction from the top side (the top opening 11) to the bottom side so that one relatively smaller disposable cigarette ash bag 1 can conveniently be inserted into one relatively bigger disposable cigarette ash bag 1.

Figure 4A:
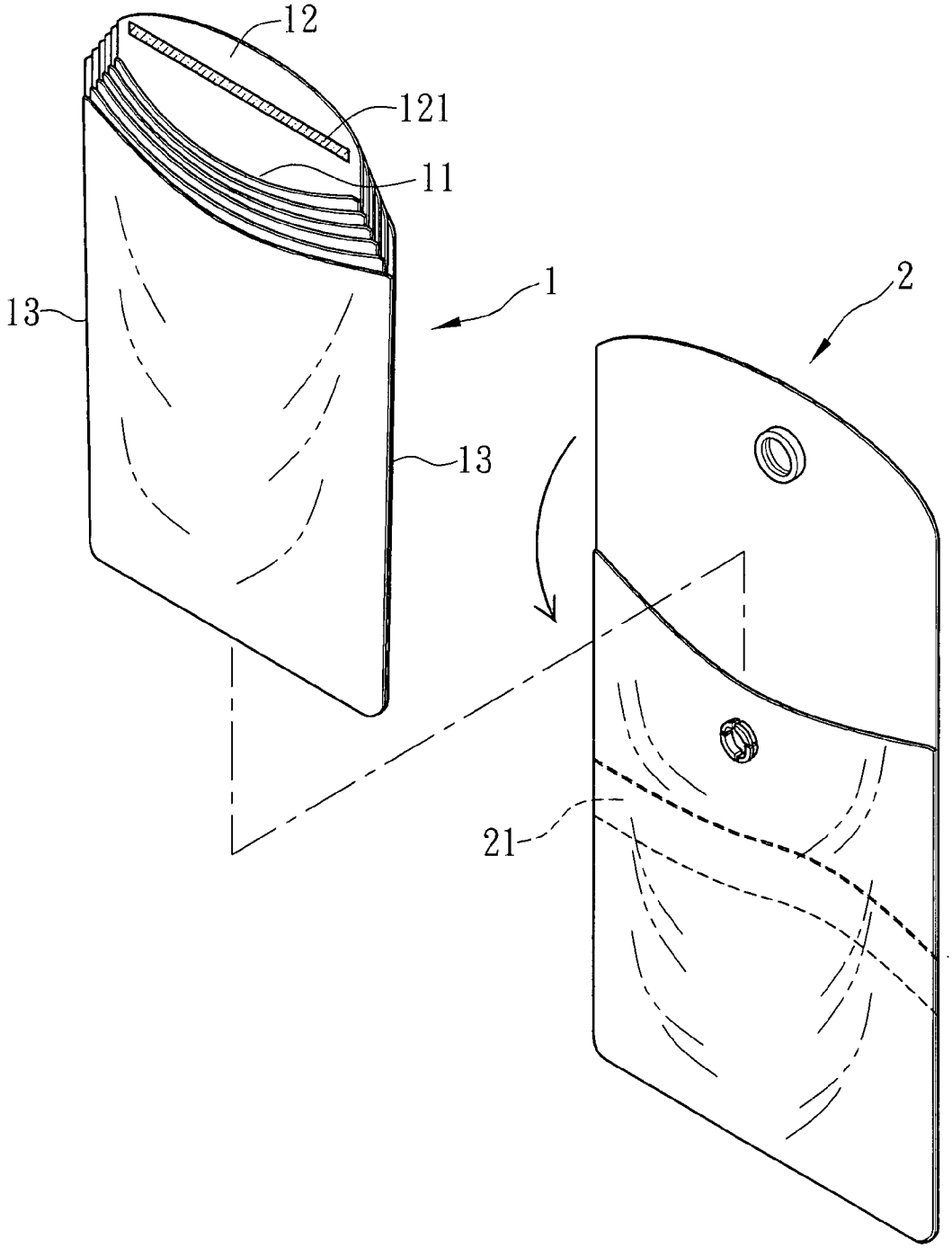
FIG. 4A illustrates a disposable cigarette ash bag package in accordance with the present invention before insertion of the set of disposable cigarette ash bags into the outer bag.
Figure 4B:
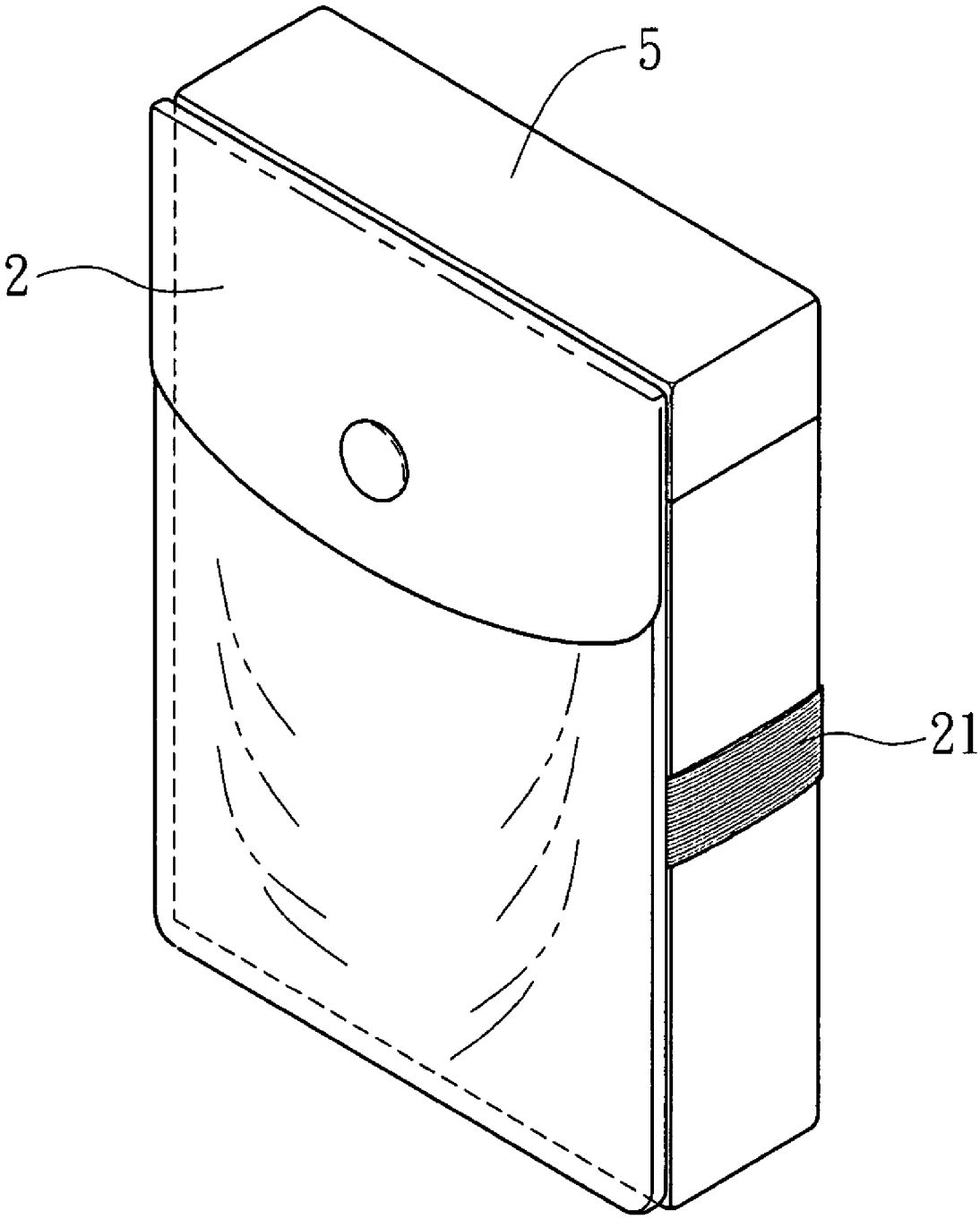
FIG. 4B shows the disposable cigarette ash bag package fastened to a package of cigarettes according to the present invention.

Referring to FIGS. 4A and 4B, the disposable cigarette ash bag package further comprises an outer bag 2 for holding the set of disposable cigarette ash bags 1. The outer bag 2 has an elastic band 21 for fastening. By means of the elastic band 21, the outer bag 2 is fastened to a package of cigarettes 5.

Figure 5:
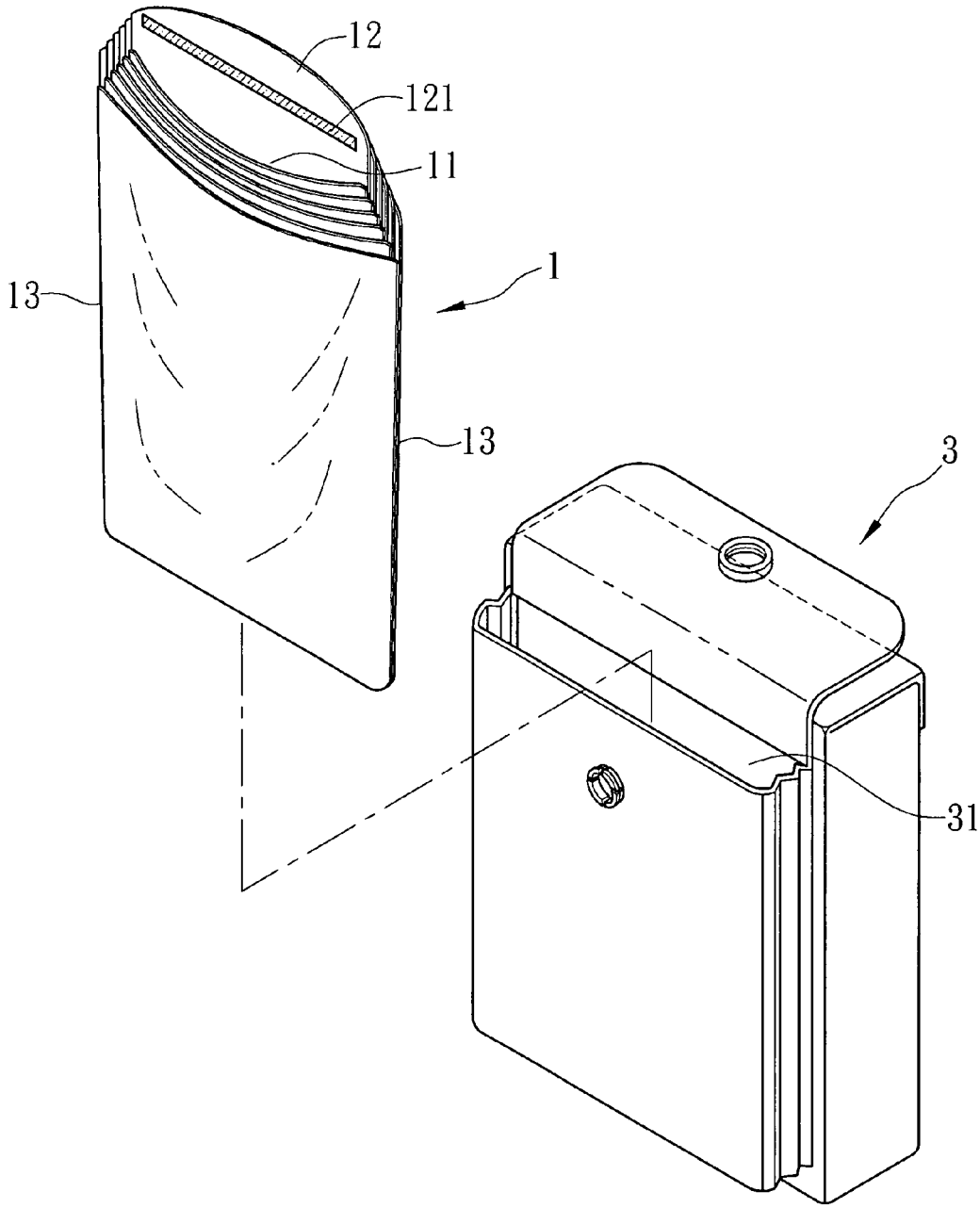
FIG. 5 is an exploded view of an alternate form of the disposable cigarette ash bag package according to the present invention.

Referring to FIG. 5, a package of cigarettes 3 is provided with an attached compartment 31 for holding the set of disposable cigarette ash bags 1.

Figure 6:
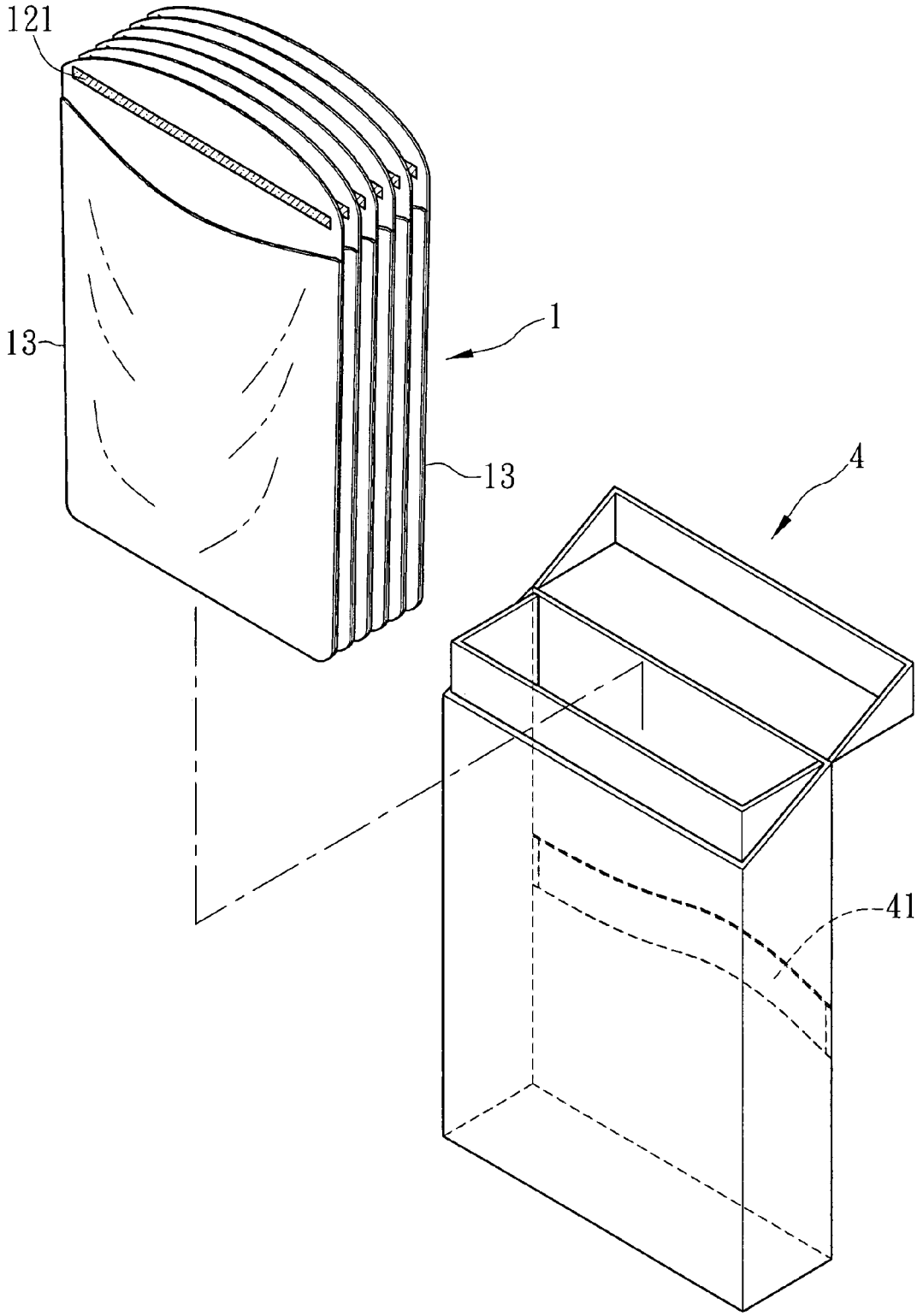
FIG. 6 is an exploded view of another alternate form of the disposable cigarette ash bag package according to the present invention.

Referring to FIG. 6, a box 4 may be used for holding the set of disposable cigarette ash bags 1. The box 4 has an elastic band 41 for fastening to a package of cigarettes.

Although particular embodiments of the invention have been described in detail for purposes of illustration, various modifications and enhancements may be made without departing from the spirit and scope of the invention.

What the invention claimed is:

1. A disposable cigarette ash bag package comprising:

a set of disposable cigarette ash bags for receiving cigarette ash individually, said set of disposable cigarette ash bags including an outer bag and a plurality of internal bags stored in substantially enveloped manner therein, said internal bags having progressively decreased width to be insertable one into another, each of said bags in the set of disposable cigarette ash bags having a bottom side, a top side defining an opening, and a cover flap extending from said top side; said cover flaps of said bags being overlaid one over another to define a stepped tabbed arrangement, whereby any adjacent pair of said bags are directly separable.

2. The disposable cigarette ash bag package as claimed in claim 1, wherein said disposable cigarette ash bags each have a width gradually reducing from the top side toward the bottom side.

3. The disposable cigarette ash bag package as claimed in claim 1, wherein said disposable cigarette ash bags each have a cover flap for closing the respective top opening, and a sealing strip for sealing said cover flap to an outer surface of the respective disposable cigarette ash bag when said cover flap closes the top opening of the respective disposable cigarette ash bag.

4. The disposable cigarette ash bag package as claimed in claim 1, wherein said disposable cigarette ash bags are made of a paper material coated with a layer of flame retardant coating.

5. A disposable cigarette ash bag package comprising:

a set of disposable cigarette ash bags for receiving cigarette ash individually, said set of disposable cigarette ash bags including an outer bag and a plurality of internal bags stored in substantially enveloped manner therein, said internal bags having progressively decreased width to be insertable one into another in substantially enveloped manner, each of said bags in the set of disposable cigarette ash bags having a bottom side, a top side defining an opening, and a cover flap extending from said top side; said cover flaps of said bags being overlaid one over another to define a stepped tabbed arrangement, whereby any adjacent pair of said bags are directly separable; and a container detachably coupled to a package of cigarettes for receiving said set of disposable cigarette ash bags.

6. The disposable cigarette ash bag package as claimed in claim 5, wherein said disposable cigarette ash bags each have a width gradually reducing from the top side toward the bottom side.

7. The disposable cigarette ash bag package as claimed in claim 5, wherein said disposable cigarette ash bags each have a cover flap for closing the respective top opening, and a sealing strip for sealing said cover flap to an outer surface of the respective disposable cigarette ash bag when said cover flap closes the top opening of the respective disposable cigarette ash bag.

8. The disposable cigarette ash bag package as claimed in claim 5, wherein said container is a bag that has an elastic band for fastening to a package of cigarettes.

9. The disposable cigarette ash bag package as claimed in claim 5, wherein said disposable cigarette ash bags are made of a paper material coated with a layer of flame retardant coating.

10. The disposable cigarette ash bag package as claimed in claim 5, wherein said container is a box that has an elastic band for fastening to a package of cigarettes.

* * * * *